US008197194B2

(12) United States Patent
Petitjean et al.

(10) Patent No.: US 8,197,194 B2
(45) Date of Patent: Jun. 12, 2012

(54) TURBINE OF A TURBOCHARGER

(75) Inventors: Dominique Petitjean, Julienrupt (FR); Phillippe Arnold, Hennecourt (FR); David Rogala, Montbelliard (FR); Patrick Masson, Urimenil (FR)

(73) Assignee: Honeywell International, Inc., Morristown, NJ (US)

( * ) Notice: Subject to any disclaimer, the term of this patent is extended or adjusted under 35 U.S.C. 154(b) by 930 days.

(21) Appl. No.: 11/579,366

(22) PCT Filed: May 3, 2004

(86) PCT No.: PCT/EP2004/004673

§ 371 (c)(1), (2), (4) Date: Sep. 2, 2008

(87) PCT Pub. No.: WO2005/106211

PCT Pub. Date: Nov. 10, 2005

(65) Prior Publication Data

US 2009/0003994 A1 Jan. 1, 2009

(51) Int. Cl.
*F01D 17/14* (2006.01)

(52) U.S. Cl. ..... 415/158; 415/177; 415/211.2; 60/602

(58) Field of Classification Search ..... 415/157, 415/158, 177, 211.2; 417/407–409; 60/602
See application file for complete search history.

(56) References Cited

U.S. PATENT DOCUMENTS

| | | | | |
|---|---|---|---|---|
| 4,339,922 | A * | 7/1982 | Navarro | 60/602 |
| 6,694,733 | B1 | 2/2004 | Bernardini et al. | |
| 6,928,816 | B2 * | 8/2005 | Leavesley | 60/602 |
| 7,021,057 | B2 * | 4/2006 | Sumser et al. | 60/602 |

FOREIGN PATENT DOCUMENTS

| | | |
|---|---|---|
| CH | 668455 | 12/1988 |
| WO | 0206636 | 1/2002 |
| WO | 2004022924 | 3/2004 |

OTHER PUBLICATIONS

Honeywell ISR/WO.

* cited by examiner

*Primary Examiner* — Edward Look
*Assistant Examiner* — Liam McDowell

(57) ABSTRACT

A turbine of a turbocharger having a floating insert which defines a nozzle for passing a fluid and that is supported axially slidable with respect to a housing by a sliding support. The turbine includes a gas shielding for preventing a flow of fluid from impinging on the sliding support.

10 Claims, 3 Drawing Sheets

TURBINE OF A TURBOCHARGER

The present invention relates to a turbine of a turbocharger and, in particular, to a turbine of a turbocharger having an adjustable throat. Furthermore, the invention relates to a turbocharger comprising such a turbine.

BACKGROUND OF THE INVENTION

In a conventional turbocharger for use in association with internal combustion engines, a turbocharger having an adjustable nozzle or throat is known from the state of the art. Such a conventional turbocharger comprises an exhaust gas driven turbine which, in turn, drives an inlet air compressor so as to compress inlet air to be supplied to a combustion chamber of the internal combustion engine.

Since the requirements with respect to emissions and fuel consumption have increased in the past, the need for a turbocharger with an improved efficiency has been established. Due to the above requirements, adjustable turbochargers for increasing the operation range based on the operation conditions of the associated internal combustion engine are needed.

BRIEF SUMMARY OF THE INVENTION

According to the state of the art, a turbine of a turbocharger comprises a floating insert which is slidably mounted with respect to a housing. The floating insert forms an annular nozzle or passage for passing the fluid towards a turbine wheel. The annular passage is adjustable by axially moving the floating insert.

It is the object of the present invention to provide a turbine of a turbocharger having an adjustable throat providing an improved reliability at decreased manufacturing costs. Furthermore, it is the object to provide a turbocharger which comprises such a turbine.

The object is achieved by a turbine of a turbocharger having a floating insert that defines a nozzle for passing a fluid, and that is supported axially slidable with respect to a housing by a sliding support means, wherein a gas shielding device is provided on an upstream side of the sliding support means. Furthermore, the object is achieved by a turbocharger having this turbine and a compressor for compressing a fluid. Further advantageous developments are defined by the additional features described below.

According to the first aspect of the present invention, a turbine of a turbocharger comprises a floating insert, said floating insert defining a nozzle for passing a fluid and being supported axially slidable with respect to a housing portion by a sliding support means. The turbine further comprises a shielding device provided on an upstream side of said sliding support means. Preferably, said sliding support means comprises a sliding shaft and a bushing slidably supporting said sliding shaft.

According to the basic concept of the present invention, the flow of high temperature exhaust gas is directed through the turbine housing or the discharge housing such that the flow of the exhaust gas is not applied directly to certain elements of the turbine which are negatively affected by a high temperature environment. In particular, those elements consist of the sliding support means of the floating insert.

In a preferable form of the invention, said shielding device comprises a skirt-shaped conical portion forming the front part of said sliding shaft so as to prevent a flow from impinging at the sliding support means. The shielding device acts as an impingement preventing means for preventing a flow of said fluid from impinging on said sliding support means.

Preferably, said floating insert is connected to the shielding device by at least one rod. In particular, the shielding device comprises at least one rod which is attached to a piston. The piston serves as a part of said nozzle.

Preferably, said skirt-shaped portion is inclined toward said sliding shaft. Thereby, the flow of the fluid can be directed in a radial direction. Additionally, the skirt-portion can be provided with means for applying a swirl to the fluid which flows along the surface thereof.

Preferably, said sliding shaft extends to the outside of said housing so as to be operable. In particular, the sliding shaft is movably relative to the housing and protrudes from the same such that any appropriate actuating means is connectable with the sliding shaft.

Preferably, said sliding shaft is encapsulated by said housing. In other words, the sliding shaft in encompassed inside the housing such that no sealing means for sealing the gap between the sliding shaft and the housing is required. The actuating means for the sliding shaft can be any appropriate internal means incorporated in the housing, such as electromagnetic, hydraulic or differential pressure driven means.

According to the second aspect of the present invention, a turbocharger comprises a turbine according to the first aspect and the associated preferable forms.

In the following, preferred embodiments and further technical solutions are described in detail with reference to the accompanying drawings.

DETAILED DESCRIPTION OF THE INVENTION

Figure 1:
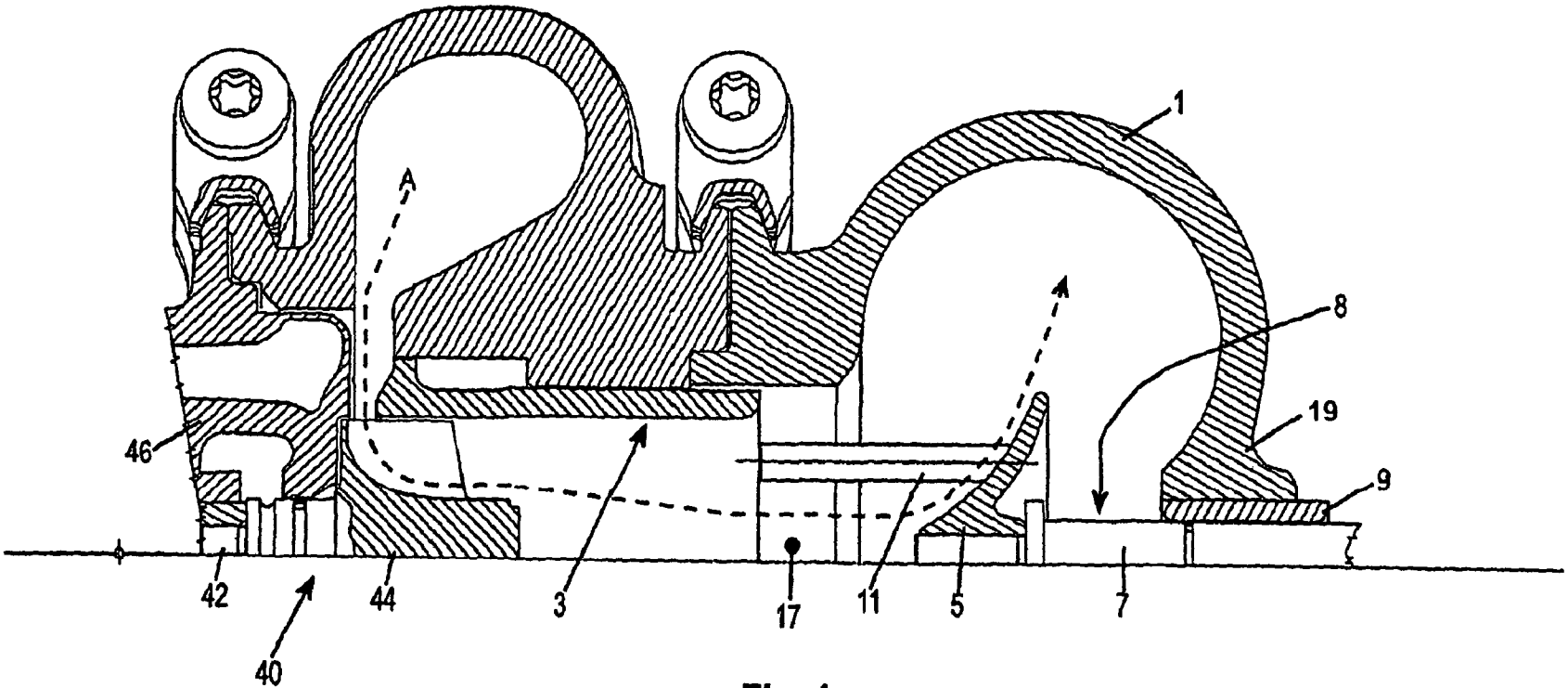
FIG. 1 is an sectional view of the turbine portion of the turbocharger according to the present invention.

In the following, the structure of the turbine portion of the turbocharger according to the present invention is explained with reference to FIG. 1. In general, a turbocharger comprises a compressor (not shown) and a turbine 40. An impeller of the compressor of the turbocharger is mounted on a shaft 42 which is driven by a wheel 44 of the exhaust gas turbine which, in turn, is driven by exhaust gas led towards the turbine wheel 44.

The turbine comprises a nozzle which is formed by an annular passage encompassing the turbine wheel 44. According to the present invention, the annular passage is formed by an inner wall of the center housing 46 and an outer wall which is formed by a front portion of a floating insert 3, a portion of which is arranged around the turbine wheel. The end of the floating insert facing towards the turbine wheel 44 is supported by a tubular surface so as to keep the radial position of the floating insert 3 with respect to the housing. The flow of the exhaust gas towards the turbine wheel 44 is indicated by an arrow A in FIG. 1.

The floating insert 3 according to the present embodiment comprises a plurality of rods 11 (e.g. three rods 11) which are provided so as to support the front portion of the floating insert 3 to a shield 5, in the form of a conical, intermediate skirt-shaped portion, forming the front part of a sliding shaft 7. The shield 5 guides the exhaust gas flowing downstream the turbine wheel 44 to a circumferential volute chamber formed by a discharge housing 1. The discharge housing 1 comprises an outlet (not shown) for discharging the exhaust gas from said discharge housing 1.

In FIG. 1, the turbine wheel 44 is disposed on the left side of the discharge housing 1 into which exhaust gas is discharged after the exhaust gas has been expanded while flowing through a turbine wheel passage 17.

Figure 2:
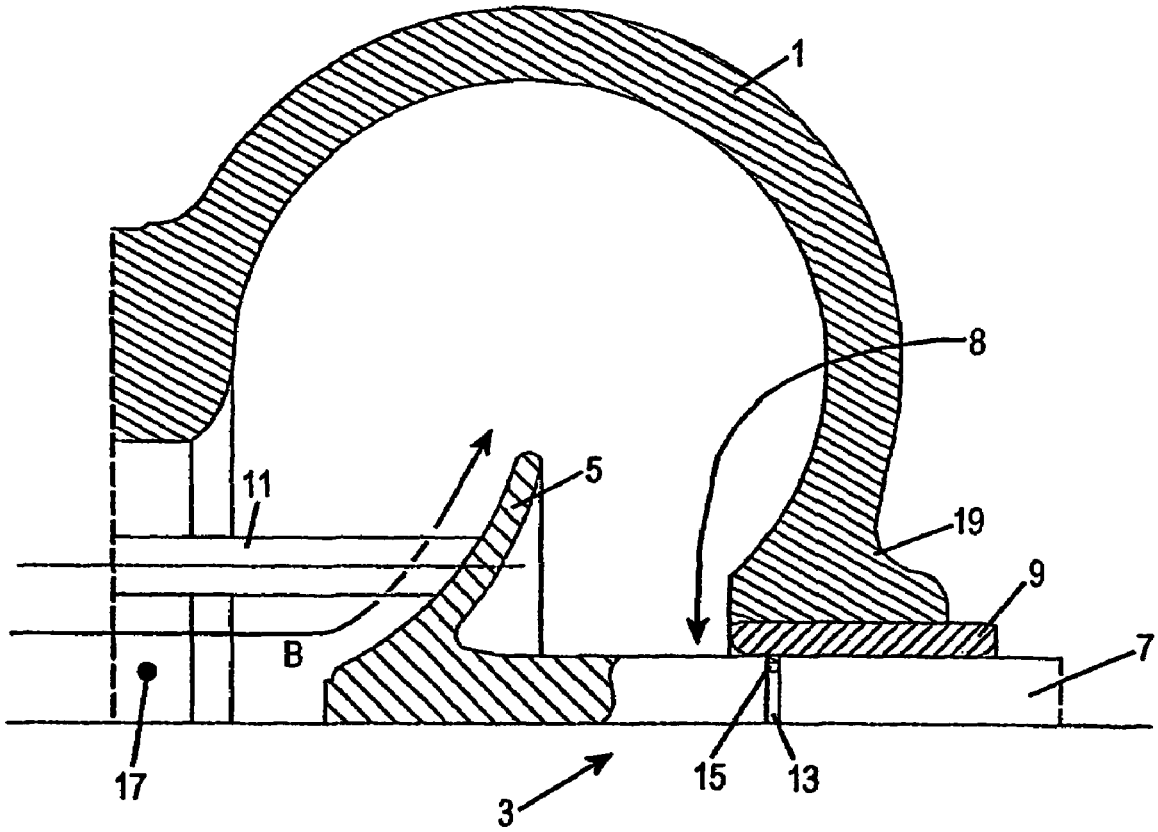
FIG. 2 is a sectional view of a housing of a turbine according to a first embodiment of the present invention.

The discharge housing 1 according to the first embodiment including the shield 5 is shown in more detail in FIG. 2.

The free end of the sliding shaft 7 opposite to the turbine wheel 44 is slidably supported by a bushing 9. This support enables a smooth and accurate movement of the sliding shaft 7 and the shield 5 in the axial direction of the sliding shaft 7. The bushing 9 for supporting the sliding shaft 7 is fit into a hole which is formed in a boss 19 of the discharge housing 1.

The shield 5 is formed such that in cooperation with the volute, the creation of a dead space or a-dead water area 8 is formed in front of the bushing 9. Thus, the shield 5 serves as a shielding device for preventing a gas flowing in the vicinity of the sliding support means of the floating insert. Here, the shield 5 is formed as an axially symmetric collar which is inclined to the right hand side of FIG. 2. The shield 5 represents a portion of the sliding shaft 7 at one end thereof which faces towards the left hand side of FIG. 2, that is, towards the turbine wheel of the turbocharger in FIG. 1.

In the following, the operation and the advantageous effects of the structure according to the present embodiment is explained.

For adjusting the annular passage for passing the exhaust gas towards the wheel of the turbine, the axial distance between the inner wall of the housing and the outer wall formed at the end of the floating insert 3 is changed. Since the portion forming the outer wall is connected to the shield 5 by the rods 11, which, in turn, are connected to the sliding shaft 7, the distance between the outer wall and the inner wall is adjusted by moving the sliding shaft 7 with respect to the discharge housing 1.

Furthermore, the exhaust gas which is discharged from the turbine flows towards the discharge housing 1 as indicated by an arrow B in FIG. 2. The exhaust gas which is discharged towards the shield 5 flows along the surface of the shield 5 and is directed towards the outer circumference of the interior of the discharge housing 1. Finally, the exhaust gas, which is directed as described above, is discharged from the discharge housing 1 to an exhaust system (not shown).

Due to the preceding combustion of fuel in the internal combustion engine, exhaust gas flowing from the passage 17 towards the discharge housing 1 is a high temperature gas. Therefore, elements exposed to a direct impingement of the flow of the high temperature exhaust gas themselves experience a heating. Furthermore, temperature differences or temperature gradients increase in those elements which are directly exposed to the high temperature exhaust gas in operation of the turbocharger.

Hence, the provision of the shield 5 prevents that the flow of the high temperature exhaust gas directly impinges on the sliding portion which comprises the sliding shaft 7 and the bushing 9. That is, the shield 5 directs the flow of the exhaust gas away from the portion where the sliding shaft 7 is supported on the bushing 9, as shown by the arrow B in FIG. 2. Therefore, the fit of the sliding shaft 7 in the bushing 9 can be set more narrow since the deviations of the inner diameter of the bushing 9 or the outer diameter of the sliding shaft 7 due to the temperature differences are reduced. Also, the freedom of selection of materials to be employed in the structure of the sliding means, such as the material of the sliding shaft 7 or of the bushing 9, can be enhanced.

Furthermore, the structure according to the present embodiment has the effect that the absolute temperature of the sliding shaft 7 and of the bushing 9 is kept lower compared with a structure in which the flow of the exhaust gas directly impinges on those portions. The decreased absolute temperature enables a structure in which a sealing member 15 such as a sealing ring or piston ring can be provided between the sliding shaft 7 and the bushing 9 which is made of a material having a relative low temperature resistance. In the present embodiment, the sealing ring is disposed in a recess 13 which is formed in the outer circumference of the sliding shaft 7.

In particular, the material of the sealing member 15 can be selected from those which are usable at the low temperature. Therefore, the costs thereof can be decreased and the reliability thereof can be enhanced.

Furthermore, this effect regarding the decreased temperature and the decreased temperature gradient in the material, the sealing ring 15 can be eliminated as a further advantage of the present invention.

Figure 3:
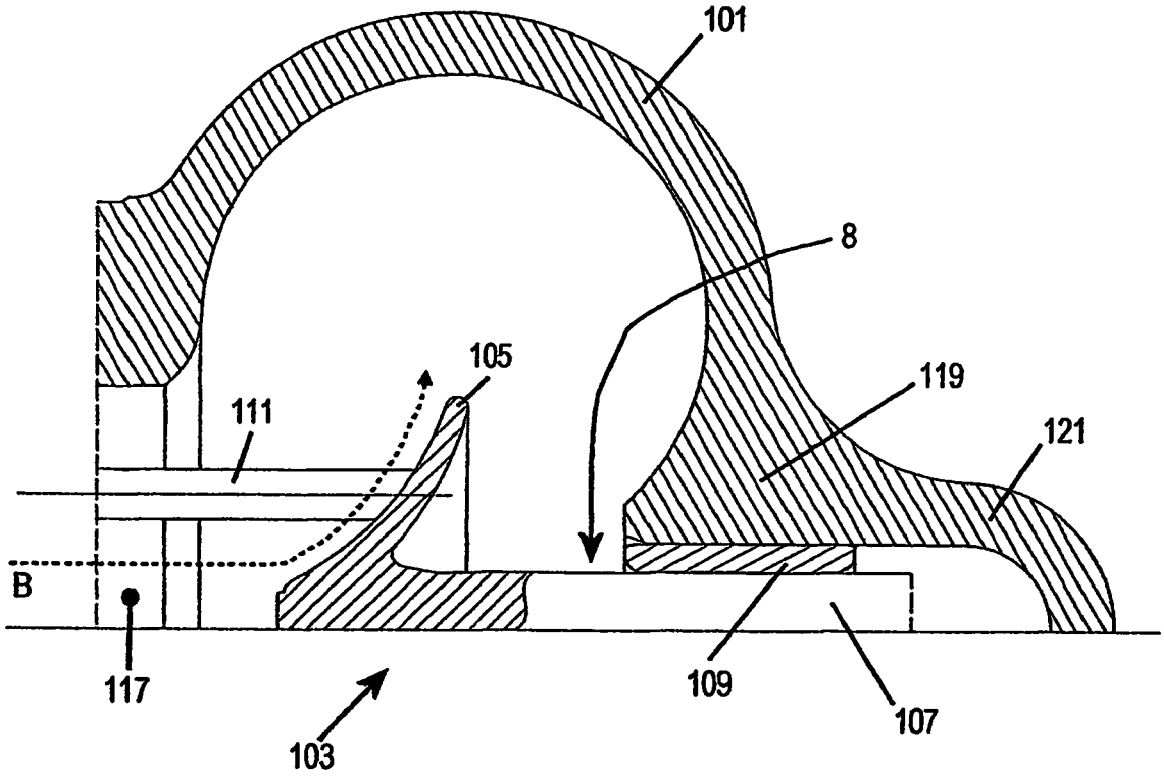
FIG. 3 is a sectional view of a housing of a turbine according to a second embodiment of the present invention.

In the following, a second embodiment of the present invention is explained with reference to FIG. 3. The structure of the embodiment shown in FIG. 3 is basically the same as the structure shown in FIG. 2. In the following, merely the differences between the structures shown in FIG. 2 and FIG. 3 are explained.

In FIG. 3, the sliding shaft 107 is slidably supported by the bushing 109. At the end of the sliding shaft 107 which faces towards the turbine, the shield 105 is provided and is of the same shape as in the structure of FIG. 2. Rods 111 are attached to the shield 105 so as to support a piston comprising the portion which serves as the outer wall of the annular passage (not shown in the Figure) and which support a piston (not shown) which is part of the floating insert 103. The exhaust gas flows from an exhaust passage 117 into the discharge housing 101 as indicated by the arrow B in FIG. 3.

According to the embodiment of FIG. 3, the bushing 109 is disposed in a hole which is formed in the boss 119 of the discharge housing 101. Furthermore, the boss 119 comprises an extension 121 which extends from the boss 119. The extension 121 forms an additional housing portion which covers the portion of the sliding shaft 107 which extends through the bushing 109. In the additional housing, which is formed by the extension 121, an actuating mechanism (not shown) for operating the sliding shaft 107 can be disposed. Thereby, the actuating mechanism can be arranged in a sealed space with influences of the environment being decreased.

As an option, the actuating mechanism can be any other means including electromagnetic, hydraulic or pressure differential driven means. For the same reasons as stated for the first embodiment, the sealing ring in the gap between the sliding shaft 107 and the bushing 109 can be eliminated, as shown in FIG. 3.

The remaining structure of the structure of the second embodiment shown in FIG. 3 is the same as the structure of the first embodiment, and the same effects are achieved.

In the first and second embodiments, in the turbine of a turbocharger the floating insert 3, 103 serves as a part of an adjustable nozzle. Furthermore, the floating insert 3, 103 supported axially slidable with respect to a discharge housing 1, 101 by sliding support means which is formed by the sliding shaft 7, 107 and the bushing 9, 109. According to the basic concept of the invention, the turbine further comprises an impingement preventing means such as shield 5, 105 for preventing a flow of said fluid from impinging on said sliding support means. In the present embodiment, the impingement preventing means is formed as the shield 5, 105 which is disposed at a upstream portion of the sliding shaft 7, 107.

The invention is not limited to the above described embodiments and modifications thereof. In particular, the single structures according to the above explained embodiments and modifications thereof can be freely combined with each other.

The invention claimed is:

1. A turbine comprising a floating insert, said floating insert defining a nozzle for passing a fluid and being supported axially slidable with respect to a housing by a sliding support means, further comprising a gas shielding device provided on an upstream side of said sliding support means, wherein said gas shielding device is disposed inside a discharge housing formed as a volute for discharging said fluid from said turbine.

2. The turbine according to claim 1, wherein said gas shielding device is an impingement preventing device for preventing a flow of said fluid from impinging on said sliding support means.

3. The turbine according to claim 1, wherein said gas shielding device comprises a skirt-shaped conical portion so as to direct the flow of said fluid into a circumferential direction of the discharge housing.

4. The turbine according to claim 3, wherein said skirt-shaped portion is inclined toward said sliding support means.

5. The turbine according to claim 1, wherein said floating insert is connected to the gas shielding device by a support structure which is permeable in the radial direction.

6. The turbine according to claim 1, wherein said sliding support means comprises a sliding shaft and a bushing slidably supporting said sliding shaft.

7. The turbine according to claim 6, wherein said sliding shaft extends to the outside of said housing so as to be operable.

8. The turbine according to claim 6, wherein said sliding shaft is encapsulated by said housing.

9. The turbine according to claim 6, wherein a sealing member is mounted between said sliding shaft and said bushing.

10. A turbocharger comprising a compressor for compressing a fluid and a turbine comprising a floating insert, said floating insert defining a nozzle for passing a fluid and being supported axially slidable with respect to a housing by a sliding support means, further comprising a gas shielding device provided on an upstream side of said sliding support means, wherein said gas shielding device is disposed inside a discharge housing formed as a volute for discharging said fluid from said turbine.

* * * * *